United States Patent [19]

Tamba et al.

[11] Patent Number: 4,964,378

[45] Date of Patent: Oct. 23, 1990

[54] ENGINE COOLING SYSTEM

[75] Inventors: Shinichi Tamba; Akio Miguchi, both of Kobe, Japan

[73] Assignee: Kawasaki Jukogyo Kabushiki Kaisha, Japan

[21] Appl. No.: 317,598

[22] Filed: Mar. 1, 1989

[30] Foreign Application Priority Data

Mar. 3, 1988 [JP] Japan ..... 63-50933

[51] Int. Cl.[5] ..... F01P 9/04

[52] U.S. Cl. ..... 123/41.57; 123/41.42; 123/41.69; 123/41.7

[58] Field of Search ..... 123/41.57, 41.67, 41.69, 123/41.7, 41.72, 41.79, 41.33, 195 C, 196 W, 41.42

[56] References Cited

U.S. PATENT DOCUMENTS

| | | | |
|---|---|---|---|
| 2,969,780 | 1/1961 | Wyczolek | 123/41.57 |
| 4,523,555 | 6/1985 | Mezger et al. | 123/193 |
| 4,530,315 | 7/1985 | Mezger | 123/41.74 |
| 4,541,368 | 9/1985 | Castarede | 123/41.33 |
| 4,688,523 | 8/1987 | Takahashi | 123/41.32 |
| 4,688,524 | 8/1987 | Takahashi | 123/41.32 |
| 4,790,273 | 12/1988 | Oguri et al. | 123/196 W |

FOREIGN PATENT DOCUMENTS

| | | | |
|---|---|---|---|
| 61-54586 | 4/1986 | Japan . | |
| 61-70121 | 4/1986 | Japan . | |
| 61-70122 | 4/1986 | Japan . | |
| 61-70123 | 4/1986 | Japan . | |
| 61-70124 | 4/1986 | Japan . | |
| 62-35855 | 9/1987 | Japan . | |
| 895902 | 5/1962 | United Kingdom | 123/41.57 |

*Primary Examiner*—Noah P. Kamen

*Attorney, Agent, or Firm*—Leydig, Voit & Mayer

[57] ABSTRACT

A cooling device is provided for an engine having a cylinder head, a crankcase and a crankcase cover. The device includes a jacket formed in the crankcase for retaining therein a liquid cooling medium, and a plurality of fins is provided on the crankcase. A cooling fan is provided and an air leading cover is arranged to surround the fan, cylinder head, crankcase and at least a portion of the crankcase cover for leading air downwardly to the fins to cool the cylinder head, crankcase and crankcase cover.

19 Claims, 3 Drawing Sheets

ENGINE COOLING SYSTEM

BACKGROUND OF THE INVENTION

1. Field of the Invention

The present invention relates to a cooling device for an engine.

2. Description of the Prior Art

Conventional engine cooling devices are classified into two types, i.e., an air cooling type that has only fins on a cylinder head and a cylinder, and a water cooling type that has only water jackets within a cylinder head and a cylinder.

The former air cooling type device suffers from the following disadvantages. (1) The cooling performance is low, and the output power is low and durability is inferior because the cooling device reaches a high temperature. (2) Since the explosion noises and the piston slap noises are leaked from the engine, the resultant noises are loud. (3) Since the thermal distribution over the entire engine is not uniform, thermal deformation is likely to be caused.

On the other hand, the water cooling type device suffers from the following disadvantages. (1) As shown in FIG. 2 a radiator 40 must be provided, for an engine, which leads to an increase in the cost of the engine unit. (2) Since the radiator 40 is arranged separately from an engine body, mountability of the device becomes inferior. (3) A large space is required for arranging the radiator in a vehicle, which makes the compactness of the device inferior. An engine equipped with the water cooling type device is shown, for example, in Japanese Utility Model Unexamined Publication No. 62-35855.

SUMMARY OF THE INVENTION

It is an object of the present invention to provide a cooling device for an engine which includes a jacket for a cooling medium liquid formed in a crankcase in a manner to surround a space in the crankcase for reducing noises leaked from the space in the crankcase to the atmosphere.

It is another object of the invention to provide a cooling device for an engine which eliminates the necessity for providing a radiator, thereby reducing the cost for manufacturing the device.

It is a further object of the invention to provide a cooling device for an engine which enhances mountability, durability and compactness of the device.

According to the invention, a cooling device for an engine of the type including a cylinder head, a crankcase, a crankcase cover and a crankshaft comprises a jacket formed in the crankcase for retaining therein a liquid cooling medium, a plurality of fins provided on the crankcase, a cooling fan for leading air to the fins and a means for conducting air downwardly over the cylinder head, the crankcase and the crankcase cover comprising an air leading cover arranged to surround the fan, the cylinder head, the crankcase and at least a portion of the crankcase cover.

Preferably, the cooling device further comprises a jacket formed in the crankcase cover for retaining therein a liquid cooling medium and a plurality of fins provided on the crankcase cover, the jacket in the crankcase cover being in communication with the jacket in the crankcase.

More preferably, the cooling device further comprises a jacket formed in the cylinder head for retaining therein a cooling medium liquid and a plurality of fins provided on the cylinder head, the jacket in the cylinder head being in communication with the jacket in the crankcase and, when provided, the jacket in the crankcase cover.

Also, it is preferable to use oil as the liquid cooling medium.

According to the invention, it is possible to reduce mechanical noises leaked from the space in the crankcase to the atmosphere because of the provision of the jackets in the crankcase and in the crankcase cover.

During the operation of the engine, the jacket in the crankcase serves to remove heat from the engine in cooperation with a cooling fan and fins cooled by the fan, thereby cooling the liquid cooling medium that has been returned from the cylinder head and again feeding the cooled liquid to the cylinder head.

DESCRIPTION OF THE PREFERRED EMBODIMENTS

The present invention will now be described in more detail with reference to the accompanying drawings.

Figure 1:
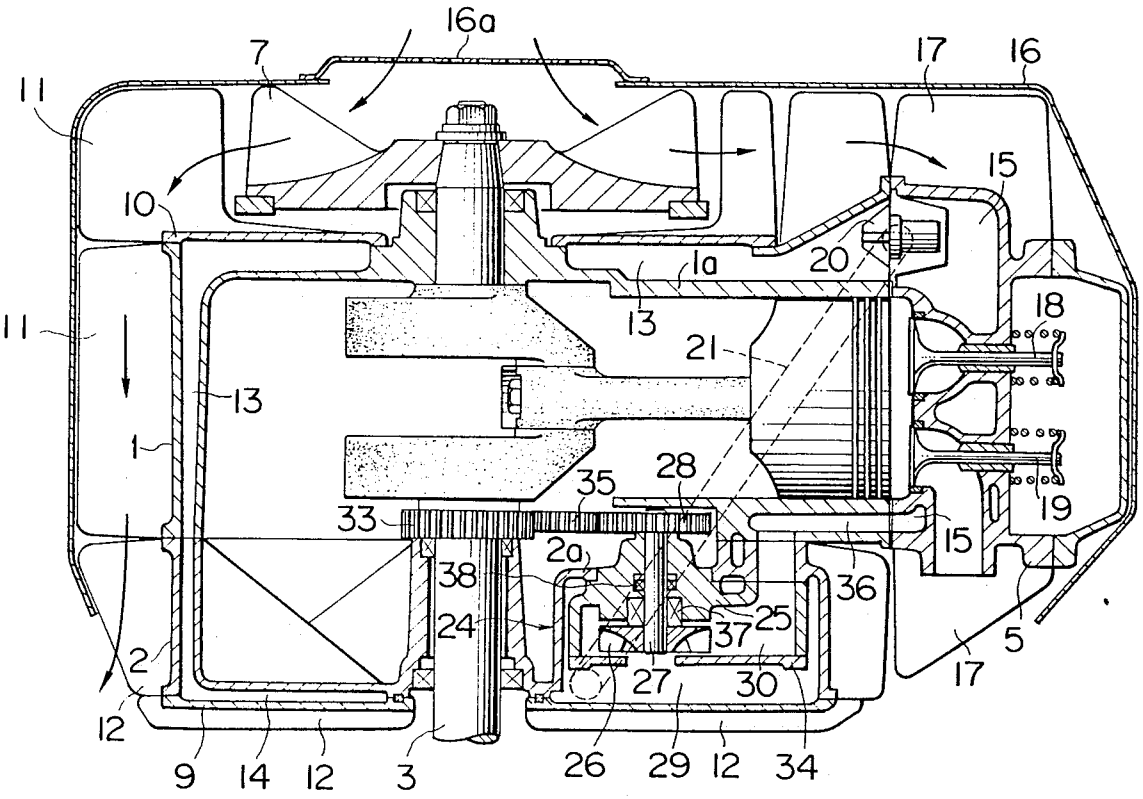
FIG. 1 is a longitudinal sectional view showing a vertical crankshaft type engine which includes a cooling device according to an embodiment of the invention.
Figure 2:
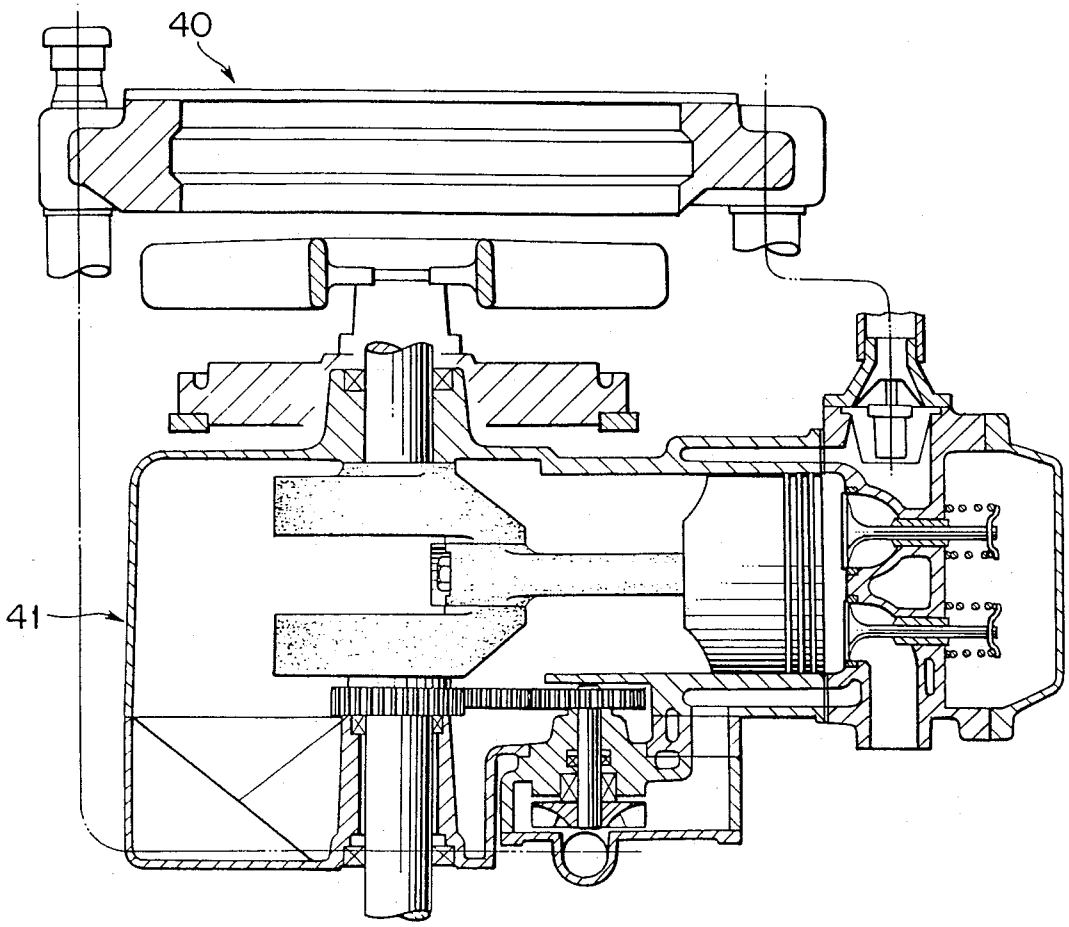
FIG. 2 PRIOR ART
FIG. 2 is a longitudinal sectional view showing a conventional liquid cooled engine.

FIG. 1 is a cross-sectional view showing a vertical shaft type engine which includes a cooling device according to an embodiment of the invention. A crankcase 1 has a cylinder portion 1*a* integral therewith. A crankcase cover 2 is secured to a lower portion of the crankcase 1. A vertically disposed crankshaft 3 is supported by the crankcase 1 and crankcase cover 2. A cooling fan 7 is fixed to an upper end of the crankshaft 3. Cooling fins 11 and 12 are formed on an outer peripheral surface of the crankcase 1 and an outer peripheral surface of the crankcase cover 2, respectively. Also, cooling fins 17 are formed integrally with an outer peripheral surface of a cylinder head 5. Reference numeral 9 denotes a lower lid for the crankcase cover 2, and reference numeral 10 denotes an upper lid for the crankcase 1.

An air leading cover 16 is provided in a manner to cover the cooling fan 7 and the respective fins 11, 12 and 17. An air introduction inlet 16*a* is formed in a part of the air leading cover 16 corresponding to a central portion of the cooling fan 7. In other words, the cooling device is so constructed that the air sucked through the air introduction inlet 16*a* is pressurized and led radially outwardly and in turn downwardly to pass through spaces where the respective cooling fins 11, 12 and 17 are provided, as indicated by arrows in FIG. 1, thereby cooling the fins. The air is then discharged downwardly. Jackets 13 and 14 for a liquid cooling medium are formed in walls of the crankcase 1 and the crankcase cover 2, respectively. Also, a jacket 15 for the liquid cooling medium is formed in the cylinder head 5 in a manner to surround an intake valve 18 and an exhaust valve 19.

The jacket 14 in the crankcase cover 2 is in fluid communication with the jacket 13 in the crankcase 1. A cooling medium liquid pump 24 is installed in the crankcase cover 2. A body case 25 of the liquid cooling medium pump 24 is mounted on a pump mount portion 2a of the crankcase cover 2. A pump shaft 27 having an impeller 26 is supported in the pump body case 25. The pump shaft 27 is drivingly connected to a crank gear 33 of the crankshaft 3 through a pump drive gear 28 and an intermediate gear 35. A mechanical seal 37 and an oil seal 38 are fixed to the pump body case 25 to ensure a sealability around the pump shaft 27. Reference numeral 34 denotes a pump case cover. An outlet portion 30 of the liquid cooling medium pump 24 is in communication with a lower portion of the jacket 15 in the cylinder head 5 through a jacket 36 formed around the cylinder portion 1a. A suction inlet 29 of the liquid cooling medium pump 24 is in communication with a lower portion of the jacket 14. An upper end portion of the jacket 15 of the cylinder head 5 is selectively switchably connected through a thermostat 20 to the jacket 13 in the crankcase 1 and a bypass passage 21. The bypass passage 21 is in direct communication with the suction inlet 29 of the cooling medium liquid pump 24. The thermostat 20 is operable to connect the head side jacket 15 to the bypass passage 21 when a temperature of the cooling medium liquid within the head side jacket 15 is not higher than a predetermined temperature, and to connect the head side jacket 15 to mainly the jacket 13 of the crankcase 1 when the temperature of the liquid is higher than the predetermined temperature.

The liquid cooling medium, such as oil, is contained in the jackets 13, 14 and 15.

In operation, when the engine is started, air is introduced through the introduction inlet 16a by the rotation of the cooling fan 7 and is led to the respective fins 11, 12 and 17 within the air leading cover 16 to cool these fins.

The cooling medium liquid (oil) pressurized by the cooling medium liquid pump 24 is fed through the outlet port 30 into the jacket 15 in the cylinder head 5 from the downside, thereby cooling the cylinder head 5.

The cooling medium liquid, the temperature of which has been elevated, is moved toward the upper portion of the jacket 15 in the cylinder head 5, and is introduced into the jacket 13 in the crankcase 1 through the thermostat 20. In the jacket 13 in the crankcase 1, the liquid cooling medium is cooled by the head-radiation from the fins 11 which is caused by the air flow produced by the cooling fan 7 and flowing along the fins 11. Namely, the jacket 13 in the crankcase 1 serves as a radiator to cool the cooling medium liquid.

The cooled liquid medium is again sucked into the liquid cooling medium pump 24 and utilized for cooling the cylinder head 5 and the like.

Incidentally, when the temperature of the cooling medium liquid in the upper end portion of the jacket 15 in the cylinder head 5 is not higher than the predetermined setting temperature of the thermostat 20, the liquid in the jacket 14 is fed directly through the bypass passage 21 to the suction port 29 of the cooling medium liquid pump 24.

Figure 3:
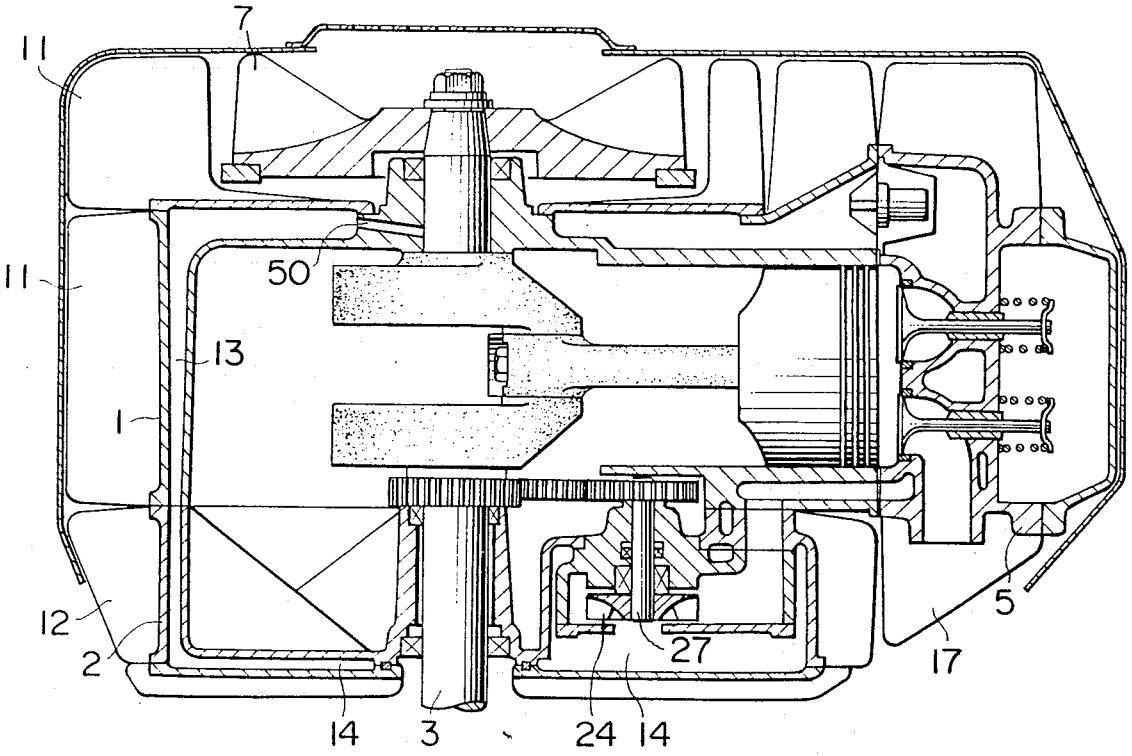
FIG. 3 is a longitudinal sectional view showing an engine which includes a cooling device according to another embodiment of the invention.

FIG. 3 shows an embodiment in which lubricant is used as the cooling medium liquid. In this embodiment, the mechanical seal 37 and the oil seal 38 are dispensed with. Therefore, the cooling medium liquid is caused to flow around the pump shaft 27, and is leaked little by little into the interior of the crankcase 1. As a result, there would be a problem that the amount of the oil within the jacket would be insufficient. However, in the arrangement shown in FIG. 3, the lubricant that has passed through an oil passage (not shown) formed in the crankshaft 3 is fed into the jacket 13 through an oil port 50, thereby replenishing the leaked liquid cooling medium.

When oil is used as the liquid cooling medium, a boiling point thereof is high in comparison with, for example, cooling water. It is therefore possible to reduce the amount of liquid cooling medium evaporated, so that the liquid cooling medium may be used for a long term. Also, when the lubricant is used as the liquid cooling medium, it is easy to seal between the lubricant and the liquid cooling medium, which leads to a cost reduction.

It is of course possible to use coolant that mainly contains water, as the liquid cooling medium.

The device according to the present invention may enjoy the following advantages.

(1) Since the jacket 13 for the liquid cooling medium surrounds the space inside the crankcase 1, mechanical noises generated within the crankcase 1 hardly escape to the outside, thereby reducing the resultant noises. When the jacket 14 for the liquid cooling medium is formed in the crankcase cover 2 as in the illustrated embodiments mechanical noises leaked to the outside may be further reduced.

(2) Since the jacket 13 is formed in the crankcase 1 in a manner to make the crankcase 1 a double-wall structure, a rigidity of the crankcase 1 may be enhanced.

(3) Since the fins 11 of the crankcase 1 are forcibly cooled by the cooling fan 7, and the jacket 15 is formed in the cylinder head 5 and is communicated with the jacket 13 in the crankcase 1, it is possible to impart a radiator function to the portion of the jacket 13 of the crankcase 1.

More specifically, notwithstanding the fact that the cooling device is of the liquid cooling type, it is unnecessary to provide a separate radiator. Thus, the manufacturing cost is low in comparison with an ordinary water cooled engine equipped with a radiator. It is also possible to enhance the compactness and mountability of the entire engine. This makes it possible to use the liquid cooled engine conveniently to the same extent as the air cooling type engine, for example in the places where dust or grass is present in large amount. In addition, the cooling performance of the engine including the cooling device according to the invention is high in comparison with the air cooled engine, and the engine to which the invention is applied is superior in output power and durability.

(4) The jackets 13, 14 and 15 are provided for the crankcase 1, crankcase cover 2 and cylinder head 5 and are communicated with each other, so that the thermal distribution over the entire engine may be uniform. Since the uniformity in thermal deformation is realized, the durability of the engine is enhanced.

(5) The fins 11, 12 and 17 are widely distributed over the entire engine, so that the height of the fins may be remarkably reduced in comparison with that of the fins of the conventional air cooled engine. Thus, it is possible to reduce noises caused by the self-induced vibration of the fins.

(6) When oil is used as the liquid cooling medium, the boiling point of the cooling medium liquid becomes higher than that of the water, so that the evaporation amount of the liquid cooling medium may be suppressed, which leads to a long service life of the cooling medium. Also, when the lubrication oil is used as the liquid cooling medium, it is possible to eliminate the mechanical seal 37 and oil seal 38, which leads to a reduction in manufacturing cost.

We claim:

1. A cooling device for an engine including a cylinder head, a crankcase, a crankcase cover and a crankshaft, said device comprising a jacket formed in said crankcase for retaining therein a liquid cooling medium, a plurality of fins provided on said crankcase, a cooling fan arranged at one end of said crankshaft for leading air to said fins and a means for conducting air downwardly over said cylinder head, said crankcase and said crankcase cover comprising an air leading cover arranged to surround said fan, said cylinder head, said crankcase and at least a portion of said crankcase cover.

2. A cooling device as set forth in claim 1, further comprising a jacket formed in said cylinder head for retaining therein a liquid cooling medium and a plurality of fins provided on said cylinder head, said jacket in said cylinder head in fluid communication with said jacket in said crankcase.

3. A cooling device of claim 2 wherein the cooling device is adapted for use in an external radiator-free engine.

4. A cooling device set forth in claim 2, further comprising means for controlling fluid communication between said jacket in said cylinder head and said jacket in said crankcase.

5. A cooling device set forth in claim 4 wherein said controlling means comprises a valve means.

6. A cooling device set forth in claim 5 wherein said valve comprises a thermostat.

7. A cooling device as set forth in claim 1, wherein said liquid cooling medium includes oil for lubrication of the engine.

8. A cooling device of claim 7 wherein the cooling device is adapted for use in an external radiator-free engine.

9. A cooling device of claim 1 wherein the cooling device is adapted for use in an external radiator-free engine.

10. A cooling device as set forth in claim 1, further comprising a jacket formed in said cylinder head, and means for pumping said liquid cooling medium directly from the lower portion of said jacket in said cylinder head towards the upper portion of said jacket in said cylinder head.

11. A cooling device as set forth in claim 1 wherein said fan is located above said engine and said air leading cover has an air introduction inlet located above and proximate to said fan.

12. A cooling device for an engine including a cylinder head, a crankcase and a crankcase cover, said device comprising jackets formed in both said crankcase and said crankcase cover for retaining therein a liquid cooling medium, said jacket in said crankcase cover being in fluid communication with said jacket in said crankcase, a plurality of fins provided on both said crankcase and said crankcase cover; and a cooling fan for leading air to said fins.

13. A cooling device as set forth in claim 12, further comprising a jacket formed in said cylinder head for retaining therein a liquid cooling medium and a plurality of fins provided on said cylinder head, said jacket in said cylinder head in fluid communication with said jackets in said crankcase and in said crankcase cover.

14. A cooling device set forth in claim 13, further comprising switchable means for fluid communication between said jacket in said cylinder head and one of said jackets in said crankcase of said crankcase cover.

15. A cooling device as set forth in claim 14 wherein said switchable communication means comprises a conduit between said crankcase cover and said jacket in said cylinder head and valve means for providing fluid communication switchably between said jacket in said cylinder head and one of said conduit and said jacket in said crankcase.

16. A cooling device as set forth in claim 13, further comprising means for controlling fluid communication between said jacket in said cylinder head and said jacket in said crankcase cover.

17. A cooling device set forth in claim 16 wherein the means for controlling fluid communication between said jacket in said cylinder head and said jacket in said crankcase cover is a conduit and valve means.

18. A cooling device set forth in claim 17 wherein said valve means comprises a thermostat.

19. A cooling device set forth in claim 17 wherein said valve means is a thermostat.

* * * * *